US009157391B2

(12) United States Patent
Waggener et al.

(10) Patent No.: US 9,157,391 B2
(45) Date of Patent: Oct. 13, 2015

(54) SYSTEMS AND METHODS FOR CONTROLLING A COMBUSTION ENGINE

(71) Applicant: EMIT Technologies, Inc., Sheridan, WY (US)

(72) Inventors: Samuel Brent Waggener, Houston, TX (US); David Wayne Haile, Sheridan, WY (US)

(73) Assignee: EMIT Technologies, Inc., Sheridan, WY (US)

( * ) Notice: Subject to any disclaimer, the term of this patent is extended or adjusted under 35 U.S.C. 154(b) by 0 days.

(21) Appl. No.: 13/829,474

(22) Filed: Mar. 14, 2013

(65) Prior Publication Data

US 2014/0260194 A1 Sep. 18, 2014

(51) Int. Cl.

| | |
|---|---|
| ***F01N 3/00*** | (2006.01) |
| ***F02D 41/02*** | (2006.01) |
| ***F02D 41/14*** | (2006.01) |
| ***F02D 41/00*** | (2006.01) |
| *F02D 41/24* | (2006.01) |

(52) U.S. Cl.

CPC ..... *F02D 41/0235* (2013.01); *F02D 41/0027* (2013.01); *F02D 41/1441* (2013.01); *F02D 41/1454* (2013.01); *F02D 41/2432* (2013.01); *F02D 41/2422* (2013.01); *F02D 41/2454* (2013.01); *F02D 2200/0414* (2013.01); *F02D 2200/604* (2013.01)

(58) Field of Classification Search

CPC ..... F02D 41/0235

See application file for complete search history.

(56) References Cited

U.S. PATENT DOCUMENTS

| | | | | |
|---|---|---|---|---|
| 4,111,170 | A | 9/1978 | Nakajima et al. | |
| 4,122,809 | A | 10/1978 | Iwasa | |
| 4,251,989 | A * | 2/1981 | Norimatsu et al. | 60/276 |
| 4,251,990 | A | 2/1981 | Norimatsu et al. | |
| 4,266,519 | A | 5/1981 | Norimatsu et al. | |
| 4,306,444 | A | 12/1981 | Hattori et al. | |
| 4,337,746 | A | 7/1982 | Masaki | |
| 4,344,317 | A | 8/1982 | Hattori et al. | |
| 4,375,796 | A | 3/1983 | Ohgami et al. | |
| 4,402,292 | A | 9/1983 | Ohgami et al. | |
| 4,526,001 | A | 7/1985 | Burns et al. | |
| 4,572,135 | A | 2/1986 | Nakajima et al. | |
| 4,729,219 | A * | 3/1988 | Kayanuma et al. | 60/274 |
| 4,739,614 | A | 4/1988 | Katsuno et al. | |
| 4,840,027 | A | 6/1989 | Okumura | |
| 5,003,440 | A | 3/1991 | Maglica | |
| 5,022,225 | A | 6/1991 | Sawada et al. | |
| 5,131,224 | A * | 7/1992 | Siewert et al. | 60/274 |
| 5,134,847 | A | 8/1992 | Ogawa et al. | |
| 5,228,226 | A | 7/1993 | Porosky | |
| 5,279,116 | A | 1/1994 | Shimizu et al. | |

(Continued)

OTHER PUBLICATIONS

WO2012157059, Fujiwara, Nov. 22, 2012, Air fuel Ratio Control Device for Internal Combustion Engine.*

*Primary Examiner* — Jesse Bogue

(74) *Attorney, Agent, or Firm* — Fish & Richardson P.C.

(57) ABSTRACT

Some implementations of a system for controlling an internal combustion engine (e.g., a natural gas fired internal combustion engine or another type of engine) can include an air-fuel ratio controller that is configured to monitor sensor feedback from an exhaust path and to thereafter automatically adjust the air-fuel mixture. The system can be employed in particular methods to control emissions from the engine, for example, by reducing pollutants emitted as components of the exhaust from the engine.

6 Claims, 5 Drawing Sheets

(56) References Cited

U.S. PATENT DOCUMENTS

| | | | | |
|---|---|---|---|---|
| 5,301,501 | A | 4/1994 | Shimizu et al. | |
| 5,379,587 | A * | 1/1995 | Toyoda | 60/276 |
| 5,806,305 | A | 9/1998 | Miller et al. | |
| 6,012,283 | A | 1/2000 | Miller et al. | |
| 6,314,724 | B1 | 11/2001 | Kakuyama et al. | |
| 6,752,135 | B2 | 6/2004 | McLaughlin et al. | |
| 6,945,035 | B2 * | 9/2005 | Hirooka et al. | 60/289 |
| 6,968,678 | B2 | 11/2005 | Le Leux et al. | |
| 6,978,774 | B2 | 12/2005 | Fisher et al. | |
| 7,082,753 | B2 | 8/2006 | Dalla Betta et al. | |
| 7,165,393 | B2 | 1/2007 | Betta et al. | |
| 7,455,058 | B2 * | 11/2008 | Raffesberger | 123/694 |
| 7,533,521 | B2 | 5/2009 | Dalla Betta et al. | |
| 7,729,847 | B2 * | 6/2010 | Mizoguchi et al. | 701/114 |
| 7,788,906 | B2 | 9/2010 | Dalla Betta et al. | |
| 8,005,603 | B2 | 8/2011 | Fisher et al. | |
| 8,117,829 | B2 * | 2/2012 | Morita et al. | 60/277 |
| 8,201,444 | B2 | 6/2012 | Wang et al. | |
| 8,206,470 | B1 | 6/2012 | Jacobson | |
| 8,245,567 | B2 | 8/2012 | Wang et al. | |
| 8,297,043 | B2 | 10/2012 | Cizeron et al. | |
| 2006/0000200 | A1 * | 1/2006 | Pott et al. | 60/285 |
| 2010/0064665 | A1 * | 3/2010 | Eckhoff et al. | 60/284 |
| 2011/0073088 | A1 * | 3/2011 | Hubbard et al. | 123/703 |
| 2011/0265451 | A1 * | 11/2011 | Gehret et al. | 60/274 |
| 2013/0074817 | A1 * | 3/2013 | Fisher et al. | 123/674 |
| 2014/0283504 | A1 * | 9/2014 | Fujiwara et al. | 60/286 |

* cited by examiner

SYSTEMS AND METHODS FOR CONTROLLING A COMBUSTION ENGINE

TECHNICAL FIELD

This disclosure relates to controlling the operation of a combustion engine, such as an internal combustion engine fueled by natural gas or propane.

BACKGROUND

Internal combustion engines use a combination of fuel and oxygen (generally obtained from the ambient air) in a combustion reaction that powers such engines. A stoichiometric air-fuel mixture ratio has just enough air to completely burn the available fuel. In practice this ideal ratio is difficult to achieve, and air-fuel ratios that are richer or leaner than the stoichiometric ratio can cause an engine to emit excess pollutants such as nitrogen oxides, carbon monoxide, and various hydrocarbons.

Some types of internal combustion engines, such as Natural Gas Fired Internal Combustion Engines (NG ICE), are commonly mounted at stationary sites (e.g., at a natural gas well or a natural gas pumping station) and are subject to rigorous compliance with Air Regulatory Permits or other governmental regulations requiring reduction of nitrogen oxides, carbon monoxide, and hydrocarbons. Normal field operation of these engines creates varying engine loads, engine speeds, ambient conditions, and fuel gas compositions that make it challenging to continuously comply with Air Regulatory Permits without manual user intervention.

In some circumstances, operators for such stationary engines use mapping techniques to establish a table/map of air-fuel ratio set points for varying locations/conditions in an effort to provide greater periods of compliance. In other words, a user physically visits each internal combustion engines that is operating at the various sites, and uses an emissions analyzing tool to manually input a set point for the air-fuel ratio of that engine based upon the engine's location and ambient conditions. Some mapping solutions require the user to define the map, while other solutions are supplied from the manufacturer with a pre-calibrated map defined for specific engine makes/models. However, when an engine is moved from a first operation site to a new operation site (e.g., moved to a new natural gas well or pumping location), the new location can create the need for a new set point to be manually input by the installer based upon a new map defined either by the manufacturer of the control solution or the user.

SUMMARY

Some embodiments of a system for controlling a combustion engine (such as natural gas or propane combustion engine mounted at a stationary site during operation) can automatically adjust the air-fuel mixture during operation for purposes of reducing or limiting pollutants emitting from an exhaust of the engine. The system can include an air-fuel ratio controller that is configured to monitor feedback from an exhaust path sensor and to thereafter automatically adjust the air-fuel mixture. The system can be employed in particular methods to limit emissions from the engine, for example, by reducing pollutants emitted as components of the exhaust from the engine. For example, the air-fuel ratio controller can include a controller that automatically adjusts the air-fuel mixture being input to the engine in response to feedback from a post-catalyst exhaust sensor (such as an oxygen or other sensor arranged to detect the engine exhaust exiting from catalyst reaction device). In such circumstances, the system can control the engine operation (optionally, without the need for manual entry of a set point for the air-fuel ratio controller) to provide an improved level of pollutant reduction of nitrogen oxides, carbon monoxide, and various hydrocarbons emitted as components of the exhaust from the engine.

Particular embodiments described herein include a system for controlling a combustion engine. The system may include a natural gas fired or propane fired internal combustion engine configured to be maintained at a stationary site during operation. The system may also include a catalyst reaction device mounted along an exhaust path of the engine. The catalyst reaction device may be configured to reduce an amount of pollutants emitted from an exhaust outlet. The system may further include a post-catalyst exhaust sensor arranged along the exhaust path after the catalyst reaction device and before the exhaust outlet. Also, the system may include an air-fuel ratio controller configured to control an air-fuel mixture input into the engine. The air-fuel ratio controller may be communicatively connected to the post-catalyst exhaust sensor. The air-fuel ratio controller may automatically adjust the air-fuel mixture input into the engine in response to a signal received from the post-catalyst exhaust sensor.

In some embodiments, a method of controlling a combustion engine can include controlling a reduction in a fuel level of an air-fuel mixture that is input into an internal combustion engine. The method may also include detecting a change in sensor feedback from an exhaust sensor arranged along an exhaust path of the internal combustion engine. The method may further include, in response to detecting the change in the sensor feedback from the exhaust sensor, maintaining the fuel level of the air-fuel mixture for a predefined period of time. Also, the method may include, after the predetermined period of time, controlling an increase in the fuel level of the air-fuel mixture that is input in the internal combustion engine.

Various embodiments described herein include an air-fuel ratio controller configured to control an air-fuel ratio of a mixture input into an internal combustion engine. The air-fuel ratio controller may include one or more processors and one or more computer memory devices, and the one or more computer memory devices can store computer-readable instructions thereon that, when executed by the one or more processors, cause a number of operations to occur. For example, the computer-readable instructions, when executed, may cause an operation of controlling an increase in a fuel level of an air-fuel mixture that is input into an internal combustion engine. Also, the computer-readable instructions, when executed, may cause an operation of detecting a change in sensor feedback from an exhaust sensor arranged along an exhaust path of the internal combustion engine. Further, the computer-readable instructions, when executed cause an operation of maintaining the fuel level of the air-fuel mixture for a predefined period of time in response to detecting the change in the sensor feedback from the exhaust sensor. Also, the computer-readable instructions, when executed cause an operation of, after expiration of the predetermined period of time, controlling a decrease in the fuel level of the air-fuel mixture that is input in the internal combustion engine.

Some embodiments described herein include an air-fuel ratio controller. The air-fuel ratio controller may be configured to control an air-fuel ratio of a mixture input into an internal combustion engine. The air-fuel ratio controller may adjust the air-fuel ratio in response to a signal received from a post-catalyst exhaust sensor.

In particular embodiments described herein, a system for controlling a combustion engine may include a catalyst reaction device configured to mount along an exhaust path of an engine. Optionally, the catalyst reaction device may include one or more catalyst reaction cartridges configured to reduce an amount of pollutants emitted from the catalyst reaction device. The system may also include a pre-catalyst exhaust sensor configured to be mounted along the exhaust path before the one or more catalyst reaction cartridges. The system may further include a post-catalyst exhaust sensor configured to be mounted along the exhaust path after the one or more catalyst reaction cartridges. Also, the system may include an air-fuel ratio controller configured to output a control signal to a fuel valve for controlling an air-fuel mixture input into the engine. The air-fuel ratio controller may communicatively connectable to the pre-catalyst exhaust sensor and the post-catalyst exhaust sensor. The air-fuel ratio controller may be configured to output the control signal to the fuel valve to adjust the air-fuel mixture based at least in part upon a signal received from the post-catalyst exhaust sensor.

Some of the embodiments described herein may provide one or more of the following benefits. First, some embodiments of the system for controlling a combustion engine can be configured to automatically and repeatedly adjust the air-fuel mixture of an internal combustion engine in a manner that limits the pollutants exiting from the system exhaust. For example, the system can employ and improved air-fuel ratio controller that automatically adjusts the air-fuel mixture input into the engine so as to advantageously improve the performance of a catalyst reaction device (e.g., a non-selective catalytic reduction (or Three-way) catalyst device) mounted along the engine exhaust path, which may generally maintain optimum pollutant reduction of nitrogen oxides, carbon monoxide, and hydrocarbons emitted as components of the exhaust from the engine.

Second, some embodiments of the system for controlling a combustion engine can be configured to provide substantially continuous compliance with Air Regulatory Permits or other governmental regulations requiring limited levels of nitrogen oxides, carbon monoxide, hydrocarbons, or other purported pollutants. For example, the air-fuel ratio controller can automatically adjust the air-fuel mixture in response to feedback from an exhaust sensor so as to provide small oscillations around the stoichiometric point of the engine so that the engine is operated at a desired air-fuel ratio for increased catalyst efficiency. In such circumstances, the catalyst reaction device mounted along the exhaust path of the engine can provide an improved level of pollutant reduction.

Third, in those embodiments of the system that include an internal combustion engine that is maintained at a stationary site during all period of operation (e.g., a natural gas engine operated at a natural gas well or a natural gas pumping station), the engine can be readily shutdown, moved to a new site, and restarted without the need for a user to manually input a set point for the air-fuel ratio. Thus, in some embodiments, the improved air-fuel ratio controller provides an engine operator with a "plug and play solution" for nearly any engine installation location using air-fuel ratio control to provide approximate stoichiometric operation of an internal combustion engine.

The details of one or more implementations are set forth in the accompanying drawings and the description below. Other features and advantages will be apparent from the description and drawings, and from the claims.

DETAILED DESCRIPTION OF ILLUSTRATIVE EMBODIMENTS

Figure 1:
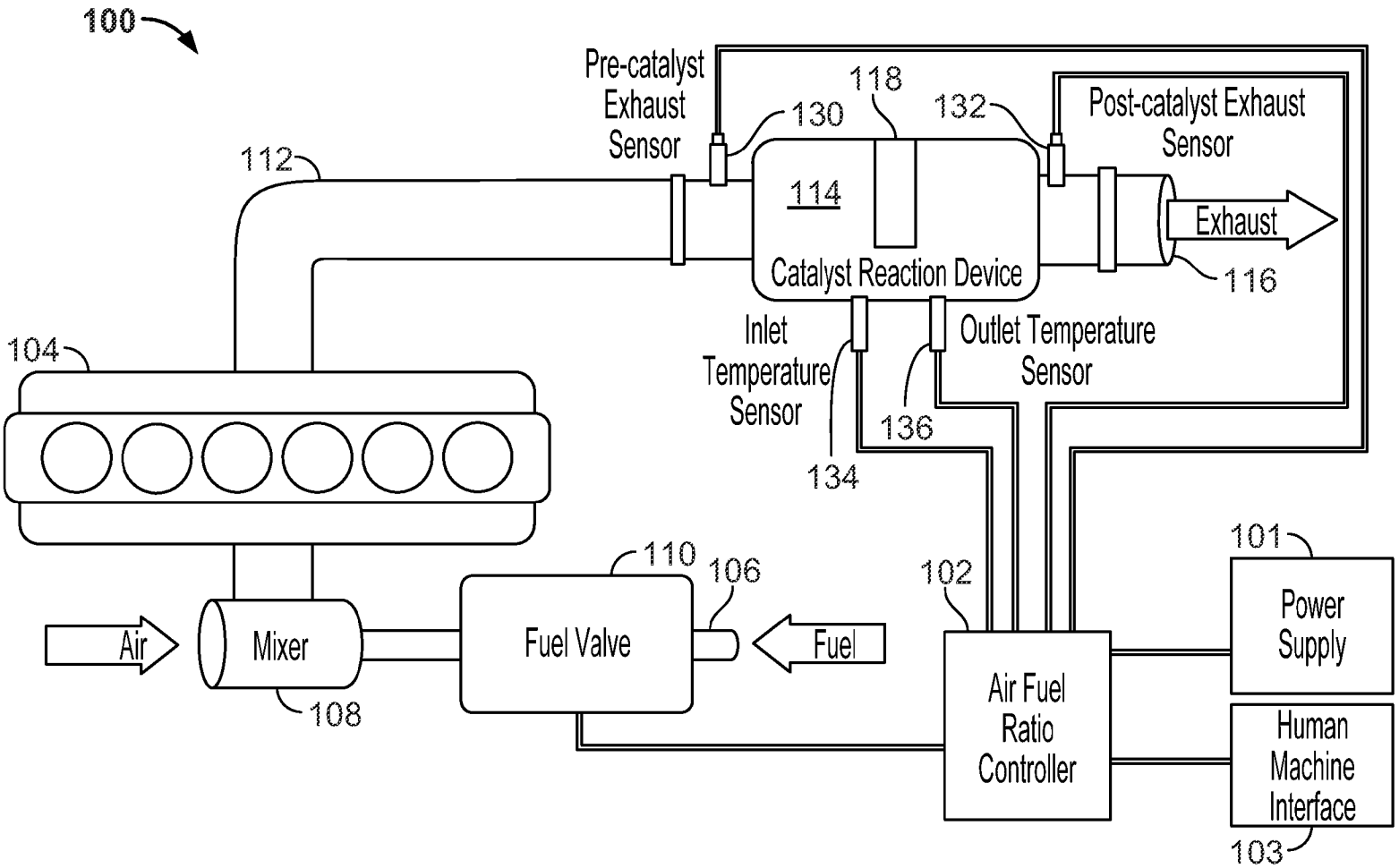
FIG. 1 is a diagram of a system for controlling a combustion engine, in accordance with some embodiments.

Referring to FIG. 1, a system 100 for controlling a combustion engine 104 includes an air-fuel ratio controller 102. In this embodiment, the combustion engine 104 is a natural gas or propane combustion engine mounted at a stationary site (e.g., stationary relative to the ground in this embodiment) during operation. Such engines can remain stationary during all periods of combustion operation, for example, when mounted at a natural gas well, at a gas pumping station, or at an emergency/back-up power station of a hospital or other building.

The combustion engine 104 consumes a mixture of fuel received at a fuel supply line 106 and air received at a mixer 108, which is configured to mix the fuel and air and provide the air-fuel mixture to the engine 104. In some embodiments, a controllable fuel valve 110 is configured to selectively adjust the amount of fuel that flows through the fuel supply line 106, thereby adjusting the air-fuel ratio of the mixture that is input into the engine 104 during operation. The controllable fuel valve 110 is communicatively connected to, and is controlled by, the controller 102. For example, the controller 102 can output signals to adjust the position of the fuel valve 110, thereby selectively controlling the air-fuel mixture ratio provided to the combustion engine 104.

Some embodiments of the controller 102 can receive electrical power from a power supply 101 (e.g., a DC power supply (12-30V) in this embodiment), and the controller 102 can furthermore receive user input through a user interface device 103. The user interface device 103 may include a touch screen display panel that is connected via a cable to a corresponding port of the controller 102. In this embodiment, the controller 102 houses one or more processors and one or more computer-readable memory devices, and may optionally further include digital electronic circuitry, integrated circuitry, specially designed ASICs (application specific integrated circuits), and other circuit devices. The one or more memory devices of the controller 102 can store computer-readable instructions that are executable by the one or more processors to cause the controller to perform the various operations described herein.

Still referring to FIG. 1, the combustion engine 104 can combust the air-fuel mixture to produce mechanical energy, and as a by-product, exhaust gasses. The exhaust gasses are output from the combustion engine 104 through an exhaust manifold 112. The exhaust gasses may include purported pollutants such as carbon monoxide, nitrous oxide, and various hydrocarbons. A catalyst reaction device 114 can be mounted to the exhaust path for purposes of reducing the amount of pollutants present in the exhaust that is released from the exhaust outlet 116 into the atmosphere. For example, the catalyst reaction device 114 can include a catalyst housing through which the exhaust gasses are passed before reaching the exhaust outlet 116. The catalyst housing can receive one or more catalyst plates 118 that include compounds and constructs configured to reduce the amount of undesirable pollutants present in the exhaust gasses. In this embodiments, the catalyst reaction device 114 comprises a non-selective catalytic reduction (or Three-way) catalyst configured to reduce the amount of Nitrogen Oxides, Carbon Monoxide, and Hydrocarbons emitted as components of the exhaust from the engine 104.

The system 100 may further include a first exhaust sensor 130 (e.g., a pre-catalyst exhaust sensor) positioned to monitor the exhaust gasses before reaching the catalyst plates 118 of the catalyst reaction device 114, and a second exhaust sensor 132 (e.g., a post-catalyst exhaust sensor) positioned to monitor the exhaust gasses after the catalyst plates 118 of the catalyst reaction device 114. In this embodiment, the first exhaust sensor 130 is positioned at an inlet 140 of the catalyst housing, and the second exhaust sensor 132 is positioned at an outlet 142 of the catalyst housing. The exhaust sensors 130, 132 are configured to sense one or more chemical elements or compounds present in the exhaust gasses. In some embodiments, the exhaust sensors 130, 132 can be oxygen sensors, such as narrow-band oxygen sensors.

The exhaust sensors 130, 132 are communicatively connected to the controller 102 to provide feedback signals that represent the levels of selected chemicals in the exhaust gasses. For example, the feedback signal from the first exhaust sensor 130 to the controller 102 can be indicative of, for example, the operating air-fuel ratio of the combustion engine 104. The feedback signal from the second exhaust sensor 132 to the controller 102 can be indicative of, for example, the catalytic efficiency of the catalyst plates 118.

In some embodiments, the exhaust sensors 130, 132 can output a signal indicative of a switching point when the engine 104 is operation at approximately the stoichiometric air-fuel ratio of combustion. As described in more detail below in connection with FIG. 3, some embodiments of the first and second exhaust sensors 130,132 may be narrowband oxygen sensors with signals that can range from 0-1000 mV, and return a relatively high voltage under fuel-rich conditions and a relatively low voltage under fuel-lean conditions. In such circumstances, the switching points for the exhaust sensors 130, 132 can indicate of how much ambient oxygen is present relative to the amount of reactive gas species in the engine exhaust stream. In an example of a fuel-rich environment, a rich mixture causes an oxygen demand, and this demand can cause a voltage to build up, due to transportation of oxygen ions through the sensor layer. In an example fuel-lean environment, the lean mixture can cause low voltage since there is a relative oxygen excess.

Still referring to FIG. 1, the inlet temperature sensor 134 and the outlet temperature sensor 136 can also be mounted to the catalyst housing of the catalyst reaction device 114. The inlet temperature sensor 134 provides information to the controller 102 indicative of the temperature of the exhaust gasses being expelled by the combustion engine 104 (e.g., indicative of the engine's operating temperature). Similarly, the outlet temperature sensor 136 provides information about the temperature of the catalyzed gasses exiting the catalyst housing (e.g., indicative of the temperature of the catalyst plates 118). A differential measurement between the temperature sensors 134, 136 can provide additional information about the catalyst reaction device 114 (e.g., indicative of whether the catalyst plates 118 have reached a predetermined operating temperature, such as a temperature at which the catalyst plates 118 may be expected to function as designed).

As described in more detail below, feedback signals from the first exhaust sensor 130, the second exhaust sensor 132, the inlet temperature sensor 134, and the outlet temperature sensor 136 are communicated to the controller 102 via cables or the like, and the controller 102 can use such information to determine a different setting for the controllable fuel valve 110. For example, the controller 102 can be programmed to monitor sensor feedback from the exhaust path (e.g., the feedback from at least the second exhaust sensor 132) and to thereafter automatically adjust the air-fuel mixture for purposes of reducing or limiting pollutants emitting from the exhaust outlet 116 of the engine.

Figure 2:
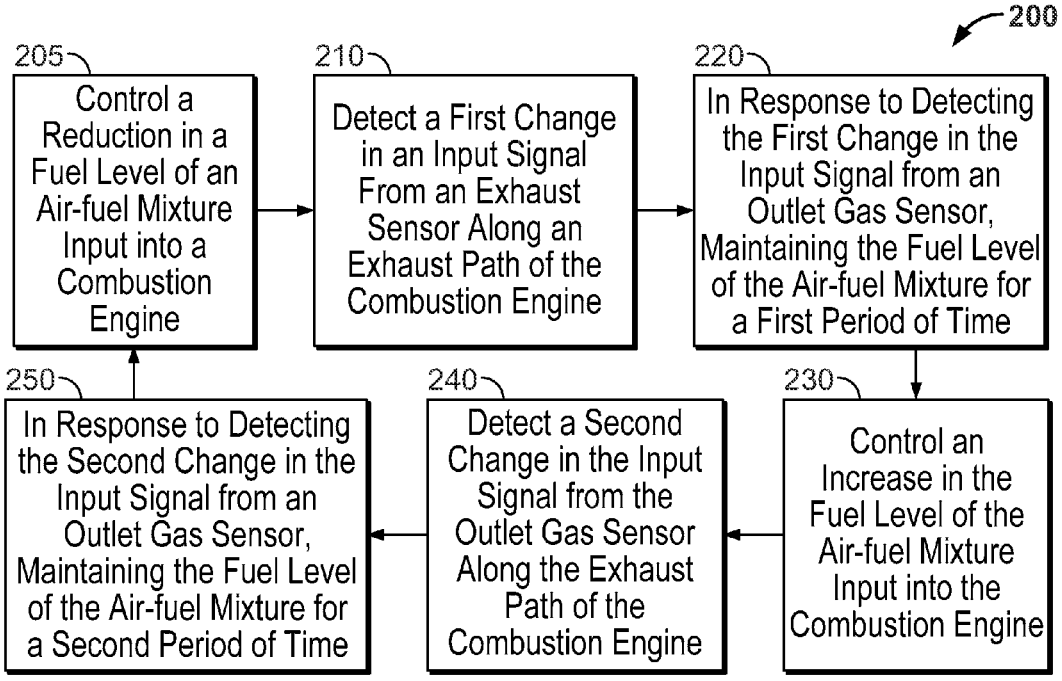
FIG. 2 is a flow chart of an example process that may be employed by an air-fuel ratio controller of the system of FIG. 1.

Referring now to FIG. 2, some embodiments of a process 200 for controlling a combustion engine can be implemented by an air-fuel ratio controller, such as the controller 102 depicted in FIG. 1. In this particular implementation, the process 200 can run in an abortable loop. The loop may be entered or exited at any appropriate point.

The process 200 can include the operation 205 that includes controlling a reduction in a fuel level of an air-fuel mixture input into a combustion engine. For example, in the context of the system 100 in FIG. 1, the controller 102 can output a control signal to the fuel valve 116 (FIG. 1) for purposes of decreasing the fuel level that is provided to the mixer 108. The fuel level may incrementally decrease as a result of the position of the fuel valve being incrementally moved toward a closed position.

In operation 210, the process 200 includes detecting a first change in a signal from an exhaust sensor along an exhaust path of the combustion engine. For example, the second exhaust sensor 132 (e.g., the post-catalyst sensor) depicted in FIG. 1 can reach a switching point as the fuel level is decreased (operation 205) so that the signal communicated from the sensor 132 to the controller switches from high to low. This change may indicate, for example, that the air-fuel mixture has progressed to a "lean" state relative to the stoichiometric air-fuel mixture ratio. The controller 102 can detect this change in the signal from the sensor 132, and respond accordingly.

For example, in response to detecting (210) the first change in the input signal from the exhaust sensor (e.g., a post-catalyst exhaust sensor in this embodiment), the controller 102 maintains (operation 220) the fuel level flowing through the controllable fuel valve 110 to the mixer 108 for a first period of time.

The process 200 that continues to operation 230, which includes controlling an increase in the fuel level of the air-fuel mixture input into the combustion engine. For example, in the context of the system 100 depicted in FIG. 1, the controller 102 can control an increase in the fuel level of the air-fuel mixture by causing the controllable valve 110 to incrementally move toward a more open position, which can increase the flow of fuel provided to the mixer 108 to provide a slightly richer air-fuel mixture to the combustion engine 104.

In operation 240, the process 200 includes detecting a second change in the signal from the exhaust sensor along the exhaust path of the combustion engine. For example, the controller 102 can detect a second change in the output of the second exhaust sensor 132 (e.g., switching from low to high). As previously described, such a detected change in the signal from the exhaust sensor 132 may indicate that the air-fuel mixture has progressed to a "rich" state relative to the stoichiometric air-fuel mixture ratio.

The process 200 can also include operation 250, which occurs in response to the detecting operation 240. For example, in response to detecting the second change in the input signal from the exhaust sensor (e.g., a post-catalyst exhaust sensor in this embodiment), the controller 102 maintains (operation 250) the fuel level flowing through the controllable fuel valve 110 to the mixer 108 for a second period of time.

At the end of the second period of time, the process 200 returns to operation 205, which includes controlling a decrease in the fuel level of the air-fuel mixture that is input into the combustion engine. For example, the controller 102 can incrementally decrease fuel level as a result of the position of the fuel valve being incrementally moved toward a closed position. Accordingly, through process 200, the fuel level of the air-fuel mixture can be repeatedly and incrementally adjusted up and down so that the air-fuel ratio is repeatedly feathered around the stoichiometric air-fuel mixture ratio for the particular combustion engine. Such a process 200 permits the engine system to self-tune thereby operate substantially at the stoichiometric point during normal field operation even under varying engine loads, engine speeds, ambient conditions, and fuel gas compositions.

Figure 3:
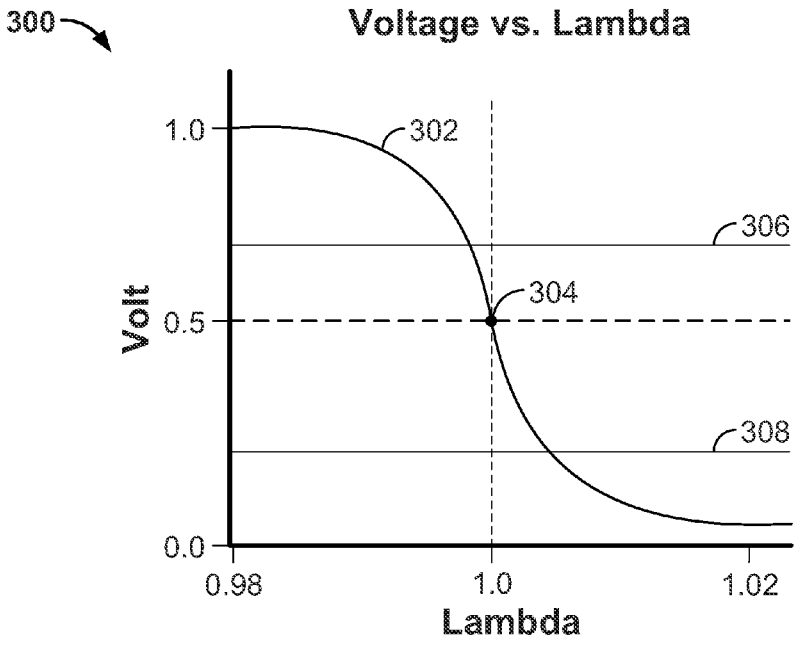
FIG. 3 is an example graph of the output signal of an exhaust sensor of the system of FIG. 1.

Referring now to FIG. 3, as previously described, some embodiments of the exhaust sensors 130, 132 can configured to provide a feedback signal that is responsive to the air-fuel ratio input into the combustion engine 104. Here, the example graph 300 of the output of the exhaust sensor 130, 132 in particular circumstances, such as an output of the post-catalyst sensor 132 reaching a switching point in the system depicted in FIG. 1. In some implementations, the signal depicted in FIG. 3 can be that of a narrowband oxygen sensor.

The graph 300 depicts a sensor output voltage curve 302 as a function of a variable "lambda". Lambda is a ratio of operating air-fuel ratio (air-fuel ratio) to the stoichiometric air-ratio given as:

$$\text{Lambda} = \frac{\text{Operating } AFR}{\text{Stoichiometric } AFR}$$

In the illustrated example, the sensor voltage output curve 302 varies from around 1.0V down to approximately 0.0V as Lambda ranges from values of about 0.98 to 1.02. When the operating air-fuel ratio is equal to the stoichiometric air-fuel ratio, lambda will be equal to 1, and the sensor output voltage will be approximately 500 mV. This point is the stoichiometric point and is represented as a point 304. The voltage produced by the second exhaust sensor 132 is most sensitive near the stoichiometric point, acting like a switch when biased from the stoichiometric point, with output voltages exceeding 500 mV being indicative of a fuel-rich air-fuel ratio, and output voltages of less than 500 mV being indicative of a fuel-lean air-fuel ratio. In some embodiments described herein, the switching point of the second exhaust sensor 132 occurs at the "lean limit" for the operation of the catalyst reaction device 114—an approximate level at which the catalyst efficiency is high and the level of pollutants output from the exhaust outlet 116 is limited. In some embodiments, when the system 100 is operated at the lean limit, the first exhaust sensor 130 may output a voltage 306 in excess of about 500 mV, and the second exhaust sensor 132 may output a voltage 308 less than about 500 mV.

In some implementations, at the lean limit the catalyst plates 118 can do at least two things. First, the catalyst plates 118 can interact with the exhaust gasses to reduce the levels of NOx, CO, and hydrocarbons (HC). Second, the catalyst plates 118 can store and discharge oxygen to aid in the completion of the reactions consuming CO and HC. Once the air-fuel ratio has reached a point that causes the voltage output from the first sensor 130 to be in excess of about 500 mV and the voltage output from the second sensor to be less than about 500 mV, then the controller 102 has determined the lean limit, and the controller 102 may repeatedly recheck the lean limit by increasing and decreasing the air-fuel ratio as described above.

Figure 4:
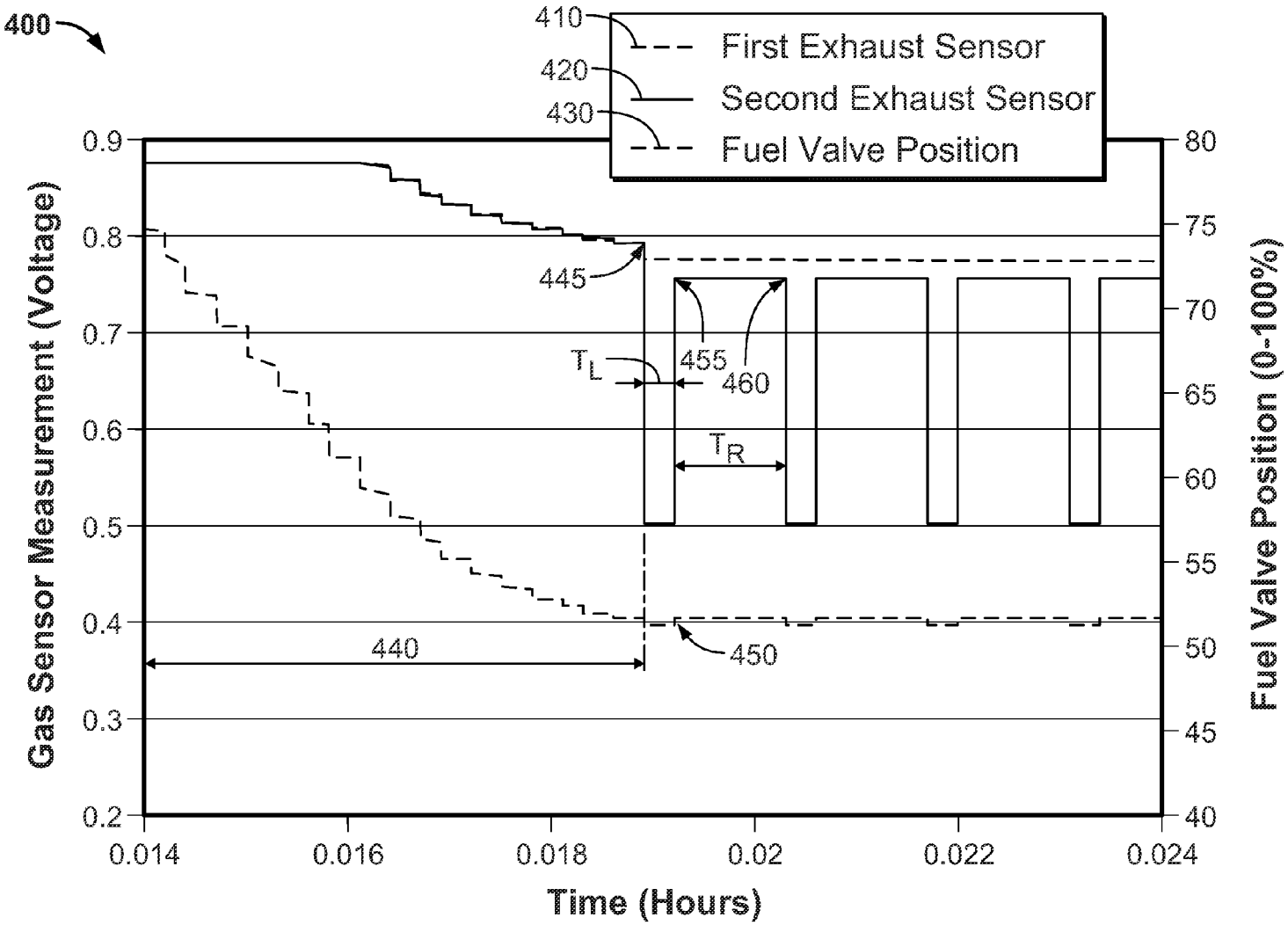
FIG. 4 is an example plot comparing the outputs of exhaust sensors of the system of FIG. 1 to the position of a fuel valve controlled by the air-fuel ratio controller of the system of FIG. 1.

Referring now to FIG. 4, an example plot 400 shows the outputs of the exhaust sensors 130, 132 and various positions of the controllable fuel valve 110 (as controlled by the controller 102). In some implementations, the plot 400 may represent the controller 102 adjusting the position of the fuel valve) in response to one or both signals from the exhaust sensors 130, 132, which (in some circumstances) may result in the air-fuel ratio being repeatedly feathered around the stoichiometric air-fuel mixture ratio for the particular combustion engine.

The graph 400 depicts a first exhaust sensor signal 410, e.g., representing the voltage output from the first exhaust sensor 130 (e.g., the pre-catalyst exhaust sensor). The graph 400 also depicts a second exhaust sensor signal 420, e.g., representing the voltage provided by the second exhaust sensor 132 130 (e.g., the post-catalyst exhaust sensor). The graph 400 further depicts a fuel valve position curve 430, e.g., representing the position of the controllable fuel valve 110, with 0% representing a closed fuel valve and 100% representing a fully open fuel valve.

The activities at the initial startup of the engine are not depicted in graph 400. At startup, the combustion engine 104 and the catalyst plates 118 may be cold. Generally speaking, neither the exhaust gas content of the combustion engine 104 nor the performance of the catalyst plates 118 are representative of the operation of the system 100 until the combustion engine 104 has reached a predefined exhaust temperature (e.g., approximately 550° F.-650° F. for some natural gas combustion engines mounted at stationary sites). For example, the combustion engine 104 may be run with a relative rich engine-starting air-fuel ratio until the engine reaches the predefined exhaust temperature.

After the combustion engine 104 reaches the predefined exhaust temperature, the controller 102 starts a process for finding the air-fuel ratio switching point. This phase is represented as phase 440. During this phase 440, the controller 102 can incrementally adjust the fuel valve position (e.g., shown as an incrementally downward staircase pattern in FIG. 4) while the second exhaust sensor signal 420 remains above a threshold level (e.g., 600 mV in this example). It should be understood, that in some embodiments, the controller 102 may include a proportional-integral-derivative (PID) controller, which can receive the signal 420 provided by the second exhaust sensor 132 and can furthermore output a signal to control the position of the fuel valve 110. As described in more detail below, the feedback from the second exhaust sensor 132 can be useful for automatically adjusting the fuel valve position to provide an air-fuel ratio that oscillates about the stoichiometric point for this particular engine.

After the fuel valve position is decreased to the point at which the second exhaust sensor signal 420 drops below the threshold level (which, as described in connection with FIG. 3, can be a significant and sharp change in the signal 420), the controller 102 has determined the lean limit for this present point in time (represented by point 445). At this point 445, the controller maintains the fuel valve position for a first period of time referred to as a "lean timer" (represented as $T_L$ in graph 400). In this particular embodiment, the lean timer $T_L$ has a predefined duration of 0.25 seconds. During the duration of the lean timer $T_L$, the second exhaust sensor signal 420 remains below the threshold level (e.g., 600 mV in this example). (It should be understood that, in some circumstances depending upon the transient combustion conditions in the engine 104 (e.g., when a methane gas combustion does not consume the methane gas as it normally would for external, transient reasons), the exhaust gasses may cause the second exhaust sensor signal 420 to momentarily increase above the threshold level before the lean timer $T_L$, is fully expired. In such circumstances, the controller 102 can respond in a manner as if the lean timer $T_L$ fully expired.)

At the expiration of the lean timer $T_L$, the controller 102 incrementally enriches the air-fuel ratio provided to the combustion engine 104 by adjusting the position of fuel valve 110 to a slightly more open position (represented by point 450). In doing so, the controller 102 incrementally adjusts the fuel valve position until the second exhaust sensor signal 420 exceeds the threshold value (which, as described in connection with FIG. 3, can be a significant and sharp change in the signal 420). When the controller 102 detects that the second exhaust sensor signal 420 exceeds the threshold value (represented at point 455, and occurring at substantially the same time as point 450), the controller maintains this fuel valve position for a second period of time referred to as a "rich timer," which is represented as $T_R$ in graph 400. (It should be understood that the magnitude of the incremental increase in the fuel valve position (e.g., at point 450 and the like) as depicted in the graph 400 for illustrative purposes only, and that in some embodiments, the actual change in position of the fuel valve would be too small to be depicted in the graph 400.)

In this particular embodiment, the rich timer $T_R$ can be in the range of 0.25 seconds to 30 seconds, depending upon a user-selected option (described below). Thus, while the duration of the rich timer $T_R$ is generally always greater than the duration of the lean timer $T_L$, the duration of the rich timer $T_R$ can be adjusted by the controller 102 according to a user-selected option.

After the rich-control timer expires, the controller 102 incrementally leans out the air-fuel ratio to once again. For example, the controller 102 incrementally and slightly adjusts the fuel valve position toward a closed position to the point at which the second exhaust sensor signal 420 drops below the threshold level. Here again, at this point 460, the controller 102 has re-determined the lean limit for this present point in time. At this point 460, the controller maintains the fuel valve position for another duration of the "lean timer" (represented as $T_L$ in graph 400).

As shown in FIG. 4, this pattern of repeatedly increasing and decreasing the position of the fuel valve so that the post-catalyst exhaust sensor is likewise repeatedly switched between high and low outputs may result in the air-fuel ratio being generally maintained at an approximate stoichiometric air-fuel mixture ratio for the particular combustion engine, the particular engine load, and the particular ambient conditions occurring at that present time. For example, as shown in FIG. 4, this process causes the controllable fuel valve 110 to minutely adjust the air-fuel ratio to make very small oscillations around the stoichiometric point on a periodic interval (e.g., anywhere from about 2 to 120 times per minute). In doing so, the engine is operated in a manner that likewise causes the catalyst reaction device 114 to maintain a preferred level of pollutant reduction of Nitrogen Oxides, Carbon Monoxide, and Hydrocarbons emitted as components of the exhaust port 116 to the atmosphere.

In some implementations, the user can select from a number of options at the user interface 103 (FIG. 1) so that the air-fuel ratio will undergo very small oscillations around the stoichiometric point with either an increased frequency or a decreased frequency. For example, the user may operate the touch screen interface 103 to set an option along a scale (e.g., a scale from 1 to 100 that, for example, causes the rich timer $T_R$ to be adjusted upper or down) so as to effectively choose between three ranges: "default," "LOW NOx," or "LOW CO." The "default" range is a middle range in the selectable scale that causes the controller 102 to adjust the position of the fuel valve according to a moderate frequency (e.g., about 5 to 20 times per minute, such as the example illustrated above in FIG. 4). The "LOW NOx" range is a lower range in the selectable scale that causes a reduction in the frequency of how often the fuel valve is incrementally adjusted toward a closed position (to cause the second exhaust sensor signal 420 to drop below the threshold level). As such, the air-fuel ratio will oscillate around the stoichiometric point relatively slowly (e.g., about 2 times per minute in this example), resulting in a decrease of Nitrogen Oxides emitted from the exhaust port 116. The "LOW CO" is an upper range in the selectable scale that causes an increase in the frequency of how often the fuel valve is incrementally adjusted toward a closed position (to cause the second exhaust sensor signal 420 to drop below the threshold level). As such, the air-fuel ratio will oscillate around the stoichiometric point relatively quickly (e.g., about 120 times per minute in this example), resulting in a decrease of Carbon Monoxide emitted from the exhaust port 116. A user's selection in any of these lower, middle, and upper ranges in the scale can result in a change in the duration of the rich timer $T_R$ (FIG. 4). For example, when the user selects an option in the "LOW NOx" range of the scale, the duration of the rich timer $T_R$ is increased, causing the air-fuel ratio to oscillate around the stoichiometric point relatively slowly. Alternatively, when the user selects an option in the "LOW CO" range of the scale, the duration of the rich timer $T_R$ is decreased, causing the air-fuel ratio to oscillate around the stoichiometric point relatively quickly. Accordingly, the user interface 103 for the system 100 can be simplified by provided a number of simple options that allow the air-fuel ratio controller to automatically determine the proper air-fuel mixture at the present time. Thus, optionally, the user interface 103 of the system 100 need not provide inputs for the user to manually input a specific set point based upon traditional mapping techniques.

Figure 5:
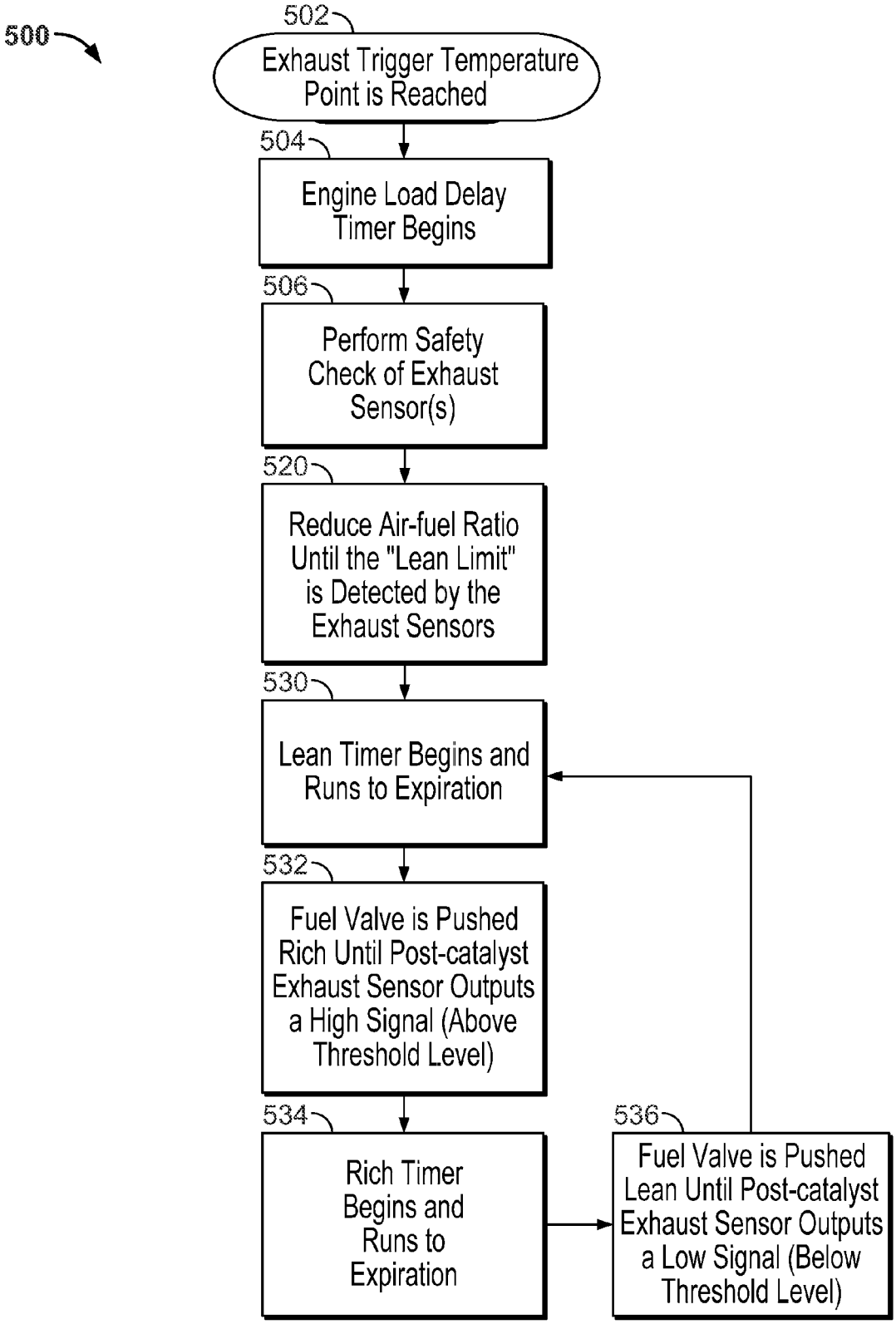
FIG. 5 is a flow chart of another example process that may be employed by an air-fuel ratio controller of the system of FIG. 1.

Referring now to FIG. 5, some implementations of a process 500 for controlling a combustion engine may include one or more precursor steps before the previously described control loop is started. In some implementations, the process 500 may be performed by the example controller 102 of the system 100 depicted in FIG. 1.

The process 500 begins when a predetermined exhaust gas temperature trigger point is reached (operation 502). For example, the controller 102 may determine that a signal from the inlet temperature sensor 134 or the outlet temperature sensor 136 indicates that the combustion engine 104 and/or the catalyst plates 118 have reached a predetermined operating temperature (e.g., approximately 550° F.-650° F. in this particular example).

After the exhaust trigger point is reached, the process 500 then begins an engine load delay timer (operation 504). The engine load time accounts for the time that that may be require for the engine to reach a steady state temperature after the operator loads the engine (which can occurs sometime after startup).

When the engine load delay expires, the process 500 includes an operation 506 in which the controller 102 performs a safety check of the exhaust sensors. For example, in some circumstances when an exhaust sensor has failed, the failed exhaust sensor is unable to output a particular level (e.g., about 777 mV in this example) because it remains permanently high or permanently low. Thus, in operation 506, each exhaust sensor is tested to verify that it is properly functioning by comparing the sensor signal to this particular voltage level. For example, the controller 102 may determine if one exhaust sensor 130 is providing a signal greater or less than about 777 mV. If that exhaust sensor output voltage is determined to be less than the particular voltage level, then the controller 102 is configured to increase the air-fuel ratio being provided to the combustion engine (which would increase the signal from that exhaust sensor output if it is properly functioning). Conversely, if that particular exhaust sensor output voltage is determined to be greater than the particular voltage level, then the controller is configured to reduce the air-fuel ratio being provided to the combustion engine (which would decrease the signal from that exhaust sensor output if it is properly functioning).

After the safety check operation 506, the process 500 can continue to operation 520 in which the controller reduces the air-fuel ratio until the "lean limit" (previously described) is detected by the one or more exhaust sensors. For example, as previously described, the controller 102 can incrementally adjust the position of the fuel valve to gradually decrease the air-fuel ratio until the post-catalyst exhaust sensor 132 outputs a low signal (while the pre-catalyst exhaust sensor remains at a high signal).

In response to detecting this change in the signal from the post-catalyst exhaust sensor 132, the process 500 continues to operation 530 so that a lean timer begins and runs to expiration. An example of the lean timer (TO is previously described in connection with FIG. 4. Then, the process 500 continues to operation 532 in which the fuel valve is pushed rich until the post-catalyst exhaust sensor outputs a high signal (above the threshold level, such as 600 mV in this example). For example, as previously described, the controller 102 can incrementally adjust the position of the fuel valve to gradually increase the air-fuel ratio until the post-catalyst exhaust sensor 132 outputs a high signal.

In response to detecting this change in the signal from the post-catalyst exhaust sensor 132, the process 500 continues to operation 534 in which a rich timer begins and runs to expiration. An example of the rich timer ($T_R$) is previously described in connection with FIG. 4. At the expiration of the rich timer, the process 500 continues to operation 536 in which the controllable fuel valve is pushed lean until the post-catalyst exhaust sensor outputs a low signal (below the threshold level, such as 600 mV in this example). For example, as previously described, the controller 102 can incrementally adjust the position of the fuel valve to gradually decrease the air-fuel ratio until the post-catalyst exhaust sensor 132 outputs a low signal. From there, the process 500 can return to operation 530, where another instance of the lean timer begins and runs to expiration.

Figure 6:
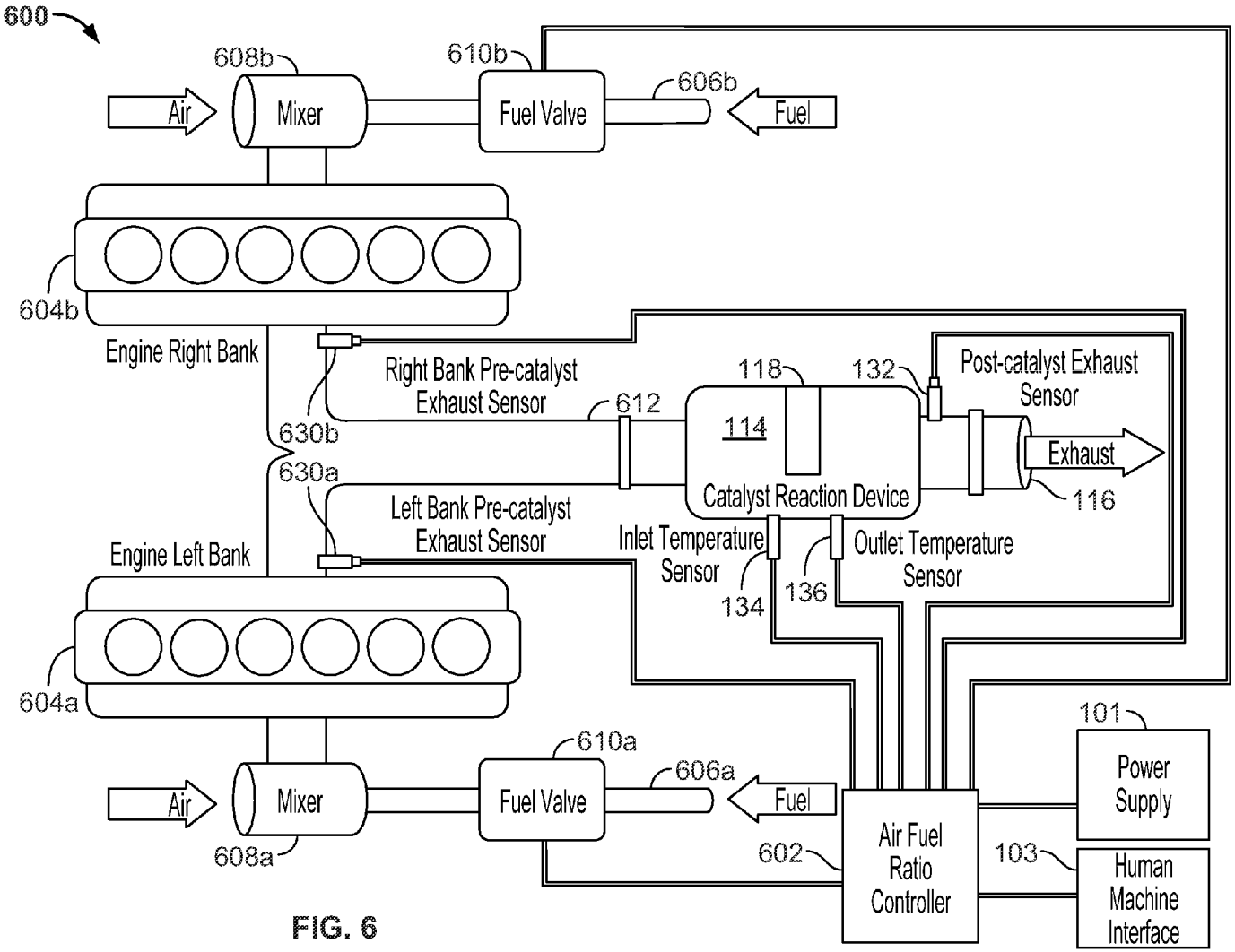
FIG. 6 is a diagram of another system for controlling a combustion engine, in accordance with some alternative embodiments.

Referring now to FIG. 6, some embodiments of a system 600 a single air-fuel ratio controller 602 to control the operation of multiple engine banks 604*a-b*. In such circumstances, the controller 602 (FIG. 6) may optionally include additional inputs and outputs as compared to the controller 102 (FIG. 1). In the embodiment depicted in FIG. 6, the system 600 includes a first combustion engine 604*a* and a second combustion engine 604*b*. In some embodiments, the combustion engines 604*a*-604*b* can be the left and right banks of a single combustion engine. In some implementations, the controller 602 can perform processes substantially similar to the processes 200 and/or 500, as modified for use with the system 600, e.g., some steps of the processes 200 and/or 500 may be repeated to operate the combustion engines 604*a* and 604*b* substantially independently.

The combustion engine 604*a* consumes a mixture of fuel received at a fuel supply line 606*a* and air received at and mixed by a mixer 608*a*. A controllable fuel valve 610*a* is controllable to selectively adjust the amount of fuel that flows through the fuel supply line 606*a*. The controllable fuel valve 610*a* is communicatively connected to, and is controlled by, the controller 602. By controlling the controllable fuel valve 610*a*, the controller 602 can selectively control the air-fuel mixture ratio provided to the combustion engine 604*a*. The controller 602 receives power from a power supply 101, and receives user input through a human machine interface (user interface) 103.

The combustion engine 604*b* consumes a mixture of fuel received at a fuel supply line 606*b* and air received at and mixed by a mixer 608*b*. A controllable fuel valve 610*b* is controllable to selectively adjust the amount of fuel that flows through the fuel supply line 606*b*. The controllable fuel valve 610*b* is communicatively connected to, and is controlled by, the controller 602. By controlling the controllable fuel valve 610*b*, the controller 602 can selectively control the air-fuel mixture ratio provided to the combustion engine 604*b*. In some implementations, the controller 602 can control the air-fuel mixture ratios provided to the combustion engines 604*a* and 604*b* independently.

The combustion engines 604*a*-604*b* combust the air-fuel mixtures to produce mechanical energy, and as a by-product, exhaust gasses. The exhaust gasses are exhausted from the combustion engines 604*a* and 604*b* through an exhaust manifold 612. The exhaust gasses generally include undesirable pollutants such as carbon monoxide, nitrous oxide, and various hydrocarbons. To reduce the amounts of pollutants present in the exhaust gasses before they are released into the atmosphere, the exhaust gasses are passed through the catalyst reaction device 114 and the catalyst plates 118 before being passed out the exhaust outlet 116.

As shown in FIG. 6, each engine 604*a-b* has a dedicated pre-catalyst exhaust sensor 630*a-b* arranged along its exhaust path before the catalyst reaction device 114. Additionally, a post-catalyst exhaust sensor 132 is arranged along the exhaust path after the catalyst reaction device 114. As previously described, the exhaust sensors 630*a-b*, 132 are configured to sense one or more chemical elements or compounds present in the exhaust gasses. The exhaust sensors 630*a-b*, 132 are communicatively connected to the controller 602 to provide signals that represent the levels of selected chemicals in the exhaust gasses. For example, the pre-catalyst exhaust sensors 630*a-b* and the post-catalyst exhaust sensor 132 may be oxygen sensors, and preferably narrowband oxygen sensors in this embodiment.

Similar to the previously described embodiments, the catalyst housing 118 is also instrumented with the inlet temperature sensor 134 and the outlet temperature sensor 136. The inlet temperature sensor 134 provides information about the temperature of the exhaust gasses being expelled by the combustion engines 604*a* and 604*b*, e.g., indicative of the engines' operating temperatures. The outlet temperature sensor 136 provides information about the temperature of the catalyzed gasses exiting the catalyst reaction device 114, e.g., indicative of the temperature of the catalyst plates 118. A differential measurement between the temperature sensors 134, 136 can provide additional information about the catalyst reaction device 114, e.g., indicative of whether the catalyst plates 118 have reached a predetermined operating temperature, e.g., a temperature at which the catalyst plates 118 may be expected to function as designed.

As previously described, feedback signals from the pre-catalyst exhaust sensors 630*a-b*, the post-catalyst exhaust sensor 132, the inlet temperature sensor 134, and the outlet temperature sensor 136 are communicated to the controller 102 via cables or the like, and the controller 102 can use such information to determine a different setting for the controllable fuel valve 610*a-b*. For example, the controller 102 can be programmed to monitor sensor feedback from the exhaust path (e.g., the feedback from at least the post-catalyst exhaust sensor 132) and to thereafter automatically adjust the air-fuel mixture for purposes of reducing or limiting pollutants emitting from the exhaust outlet 116 of the engine.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A system for controlling a combustion engine, comprising:

a catalyst reaction device configured to mount along an exhaust path of an engine, the catalyst reaction device including one or more catalyst reaction cartridges configured to reduce an amount of pollutants emitted from the catalyst reaction device;

a pre-catalyst exhaust sensor configured to be mounted along the exhaust path before the one or more catalyst reaction cartridges;

a post-catalyst exhaust sensor configured to be mounted along the exhaust path after the one or more catalyst reaction cartridges; and an air-fuel ratio controller configured to output a control signal to a fuel valve for controlling an air-fuel mixture input into the engine, the air-fuel ratio controller being communicatively connectable to the pre-catalyst exhaust sensor and the post-catalyst exhaust sensor, wherein the air-fuel ratio controller is configured to output the control signal to the fuel valve to increase a fuel level in the air-fuel mixture in response to the signal received from the post-catalyst exhaust sensor switching from a high signal to a low signal during a period when the signal received from the pre-catalyst exhaust sensor is continuously maintained as a high signal.

2. The system of claim 1, wherein the air-fuel ratio controller is configured to increase the fuel level in the air-fuel mixture after expiration of a constant-value lean timer that begins in response to the controller detecting the signal received from the post-catalyst exhaust sensor switching from the high signal to the low signal.

3. The system of claim 1, wherein the air-fuel ratio controller comprises a user interface display device, and wherein the air-fuel ratio controller configured to control an air-fuel mixture input into a stationary natural gas fired or propane fired internal combustion engine.

4. The system of claim 2, wherein the air-fuel ratio controller is configured to decrease the fuel level in the air-fuel mixture after expiration of a constant-value rich timer that begins in response to the controller detecting the signal received from the post-catalyst exhaust sensor switching from the low signal to the high signal.

5. The system of claim 4, wherein the constant-value rich timer is always greater than the constant-value lean timer.

6. The system of claim 4, wherein a magnitude of the constant-value rich timer is user selectable via a user interface device of the air-fuel ratio controller.

* * * * *